US006815404B2

(12) United States Patent
Becker

(10) Patent No.: US 6,815,404 B2
(45) Date of Patent: Nov. 9, 2004

(54) DETERGENT

(75) Inventor: Klaus Becker, Hamburg (DE)

(73) Assignee: BBT Bergedorfer Biotechnik GmbH, Hamburg (DE)

( * ) Notice: Subject to any disclaimer, the term of this patent is extended or adjusted under 35 U.S.C. 154(b) by 13 days.

(21) Appl. No.: 10/455,797

(22) Filed: May 30, 2003

(65) Prior Publication Data

US 2004/0014622 A1 Jan. 22, 2004

Related U.S. Application Data

(63) Continuation of application No. PCT/EP01/13684, filed on Nov. 23, 2001.

(30) Foreign Application Priority Data

Dec. 1, 2000 (DE) ..... 100 59 642

(51) Int. Cl.[7] ..... C11D 1/94; C11D 3/10; C11D 3/26; C11D 3/386

(52) U.S. Cl. ..... 510/195; 510/191; 510/392; 510/393; 510/435; 510/499; 210/601; 210/606; 210/636

(58) Field of Search ..... 510/191, 195, 510/392, 393, 435, 499; 210/601, 606, 636

(56) References Cited

U.S. PATENT DOCUMENTS

| | | | | |
|---|---|---|---|---|
| 5,532,162 | A | 7/1996 | Aamot | |
| 5,674,831 | A | 10/1997 | Schulz et al. | |
| 5,698,513 | A | 12/1997 | Schulz et al. | |
| 5,931,172 | A | 8/1999 | Steer et al. | |
| 2002/0023875 | A1 * | 2/2002 | Lorenz et al. | 210/601 |
| 2004/0072715 | A1 * | 4/2004 | Griese et al. | 510/405 |

FOREIGN PATENT DOCUMENTS

| | | | |
|---|---|---|---|
| DE | 3906124 | 8/1990 | C11D/3/386 |
| DE | 94 14773 | 3/1996 | |
| DE | 199 14 790 A1 | 10/2000 | |
| DE | 199 14 791 A1 | 10/2000 | |
| DE | 100 59 642 | 2/2003 | |
| WO | WO-95/18212 A1 | 7/1995 | |
| WO | 00/11130 | 3/2000 | C11D/11/00 |
| WO | WO-00/66155 | 11/2000 | |
| WO | WO00/68155 A1 * | 11/2000 | |

OTHER PUBLICATIONS

Database WPI Section Ch, Week 199734, Derwent Publications Ltd. Class A97, AN 1997–369814 XP002202593 & JP 09 157699 Jun. 1977.

"Chemical Abstracts + Indexes, 115, 210743p" Chemical Abstracts, American Chemical Society, Columbus US, 1991, XP000251853 ISSN:0009–2258.

* cited by examiner

*Primary Examiner*—Gregory R. Del Cotto
(74) *Attorney, Agent, or Firm*—Darby & Darby

(57) ABSTRACT

The invention relates to a cleaning agent, particularly for cleaning sewers, for fat and/or protein-containing sewage from the home or having a municipal or industrial origin, with a content of urea, a urea derivative, a urea salt and/or a urea derivative salt, the cleaning agent containing approximately 50 to 90 wt. % urea, urea derivative, urea salt and/or urea derivative salt, based on dry substance, and an alkaline-acting agent, protease and fat-degrading microorganisms.

22 Claims, No Drawings

DETERGENT

This application is a Continuation of PCT/EP01/13684 filed Nov. 23, 2001.

The invention relates to a cleaning agent, particularly or cleaning sewers, for fat containing and/or protein-containing sewage from the home or having a municipal or industrial origin having a content of urea, a urea derivative, a urea salt and/or a urea derivative salt.

A process of the aforementioned type is disclosed in EP-B-236 989, which prescribes the use of supplines, e.g. in the form of nitrogen-containing compounds. This known proposal is based on the finding that microorganisms are frequently so specialized that they require supplines for life. Supplines are essential substances belonging to the elementary constituents of the cell and which cannot be synthesized by individual organisms. They are e.g. amino acids, purines, pyrimidines, organic acids, carbohydrates, together with vitamins, particularly phenyl alanine, arginine, aspartic, oxalic, malic, malonic and propionic acids. With regards to their function and concentration, supplines differ clearly from nutrients. They correspond to vitamins in the animal and human diet. As nutrients, which fundamentally differ from supplines, the following compounds can be given: ammonium, nitrate and phosphate ions, glucose, polysaccharide, proteins and carbohydrates. For cleaning sewers for fat-containing sewage from the home or industrial enterprises the supply of supplines for fat-degrading or emulsifying bacteria prevents the formation of a plug in the sewer or if a plug of this type has already formed, easily brings about the dissolving thereof. Thus, according to the known proposal there is a biological decomposition of the fat through the bacteria present in the sewage. Suppline combinations for promoting fat-degrading or emulsifying bacteria are applied to the plug in the sewer either alone or combined with a detergent. The suppline combination permits a rapid growth of the desired bacteria, which leads to the dissolving of the disturbing fat plug in the sewer. The fat-degrading or emulsifying bacteria are constituted by a wide range of bacteria, which are normally present in the sewage. To promote the penetration of supplines into the fat plug and in order to assist the microbial dissolving of the fat, it is possible to add a detergent. The same purpose is served alone or in combination with the detergent, the addition of a CO2-developing powder, e.g. effervescing powder, which comprises approximately 50 wt. % sodium bicarbonate and approximately 50 wt. % tartaric acid.

The above proposal has proved very valuable in practice, but requires improvement. Another prior art process can be gathered from DE 44 17 809 A1. The latter describes a process for sanitary cleaning using a sanitary cleaner in liquid or solid form, which has a minimum content of germ-inhibiting, organic substances, together with conventional lime-dissolving, water-soluble acids, germ-promoting, organic substances and further additives and it contains e.g. urea as the germ-promoting, organic substance. This application discloses a two-stage action system, according to which in a first phase the germ-inhibiting substances and in a second phase the germ-promoting substances bring about the cleaning of the sewage.

EP 184 416 A2 discloses a cleaning block for toilets, which is dissolved in the water tank and has a composition of 5 to 85 wt. % of one or more anionic surfactants, 2 to 50 wt. % of one or more solubility control agents and 0.5 to 50 wt. % of at least one water-soluble, polyvalent metal salt, such as e.g. crystal water-containing magnesium sulphate.

PCT/EP 00/04135 offers a significant improvement compared with the above-described processes or cleaning agents. The teaching described therein seeks to improve the action on the sewer-blocking plug and parts thereof in such a way that there can be both an easier and faster physical and also biochemical dissolving of plugs or parts thereof in the sewer and sewage.

This prior art also provides a proposal in this direction. It consists of a process for cleaning sewers for fat-containing sewage from the home or industrial enterprises, in which to the fat-degrading and/or fat-emulsifying bacteria contained in the sewage are added nitrogen-containing compounds and which is characterized in that 1. to a liquid effluent cleaner are additionally added urea, a urea derivative, a urea salt and/or a urea derivative salt and 2. to a solid effluent cleaner are additionally added urea, a urea derivative, a urea salt and/or a urea derivative salt and/or anhydrous magnesium sulphate, growth factors in the form of supplines being largely excluded, and in 1. and 2. the quantity of germ-inhibiting, organic substance is below 0.5 g/kg, preferably below approximately 0.3 g/kg, particularly below approximately 0.1 g/kg sewer effluent cleaner. Preferably urea is used, particularly in a quantity of 0.1 to 20 wt. %, based on the solid content. Use can advantageously also be made of urea phosphate, particularly in a quantity of 0.2 to 40 wt. %, based on the solid content. It is generally stated that fat, protein and carbohydrate-degrading enzymes and/or microorganisms can be used.

However, it is a particular characteristic of this proposal that not only are growth factors in the form of supplines largely excluded, but that in a solid sewer cleaner the quantity of germ-inhibiting, organic substances must be below 0.5 g/kg, particularly below 0.3 g/kg and more especially below 0.1 g/kg effluent cleaner. These are in particular acid, organic substances or their salts or suitable derivatives and essential oils. These more particularly include aliphatic carboxylic acids, lower carboxylic acids with 1 to 7 carbon atoms, such as more particularly formic, acetic, propionic, caproic, malonic and oxalic acids, as well as various fatty acids with 6 to 12 carbon atoms, e.g. sorbic acid or undecenoic acid, provided that they are usable in the form of suitable, water-soluble salts. Suitable derivatives of the aforementioned carboxylic acids are hydroxy acids, such as glycolic, tartaric and citric acids, as well as oxo acids, such as acetoacetic and pyruvic acids. Particularly suitable are also adequately water-soluble, aromatic carboxylic acids, such as in particular benzoic, salicylic and also other phenocarboxylic acids. Thus, the proposal of PCT/EP 00/04135 aims to exclude such germ-inhibiting, organic substances. This does not apply to the subsequently described cleaning agent according to the invention. It has been found that the last-described, technical proposal for cleaning sewers requires improvement and in particular an improved plug dissolving capacity must be sought.

Therefore the object of the invention is a cleaning agent, particularly for cleaning sewers, for fat and/or protein-containing sewage from the home or having a municipal or industrial origin and having a content of urea, a urea derivative, a urea salt and/or a urea derivative salt, which is characterized in that the cleaning agent contains approximately 50 to 90 wt. % urea, urea derivative, urea salt and/or urea derivative salt, based on dry substance, and an alkaline-acting agent, protease and fat-degrading microorganisms.

Thus, in complete contradiction to the procedure according to the prior art, the agent according to the invention uses an unusually high proportion of urea, urea derivative, urea salt and/or urea derivative salt, based on dry substance, namely approximately 50 to 90, preferably approximately 60 to 80 and in particular approximately 65 to 75 wt. %. The urea is not only germ-promoting during the targeted use of the cleaning agent according to the invention, but also acts in solubility-increasing manner for the inventively used proteases and also acts as a nitrogen source for the fat-degrading bacteria. It also has a dissolving function on proteins which may have to be removed. The germ-promoting, organic substance in the form of urea or urea derivative can fundamentally be an open-chain or cyclic compound of formula (I) R1R2N—CO—NR3R4, in which R1 to R4, in each case independently of one another, can be present in open-chain or cyclized form and can have the following meanings: hydrogen, a lower alkyl group with 1 to 4 carbon atoms, a cycloalkyl group with 3 to 6 carbon atoms, an aryl group in the form of a phenyl or naphthyl residue, an aralkyl group with 7 to 18 carbon atoms, or an O, S or N-containing heterocyclic group with 2 to 5 carbon atoms, the compound of formula (I) being wholly or partly present in the form of a salt.

Thus, the following urea derivatives are covered by the above formula (I):

R1R2N—CO—N N—CO—N and

R1N—CO—NR2

In formula (I) the groups R1, R2, R3 and R4 are preferably hydrogen, because the corresponding starting compounds are commercially available or can be easily prepared. Suitable within the scope of the present invention are in particular the substituents, which are given in the above definition of the invention. As a lower alkyl group with 1 to 4 carbon atoms can in particular be used the methyl, ethyl, n-propyl, i-propyl and the different isomers of the butyl group. The cycloalkyl group with 3 to 6 carbon atoms more particularly covers the cyclopropyl, cyclobutyl, cyclopentyl and cyclohexyl group, whilst the aralkyl group with 7 to 18 carbon atoms particularly covers the benzyl and phenethyl group. The alkylaryl group with 7 to 18 carbon atoms particularly covers the tolyl group, whilst the heterocyclic group with 2 to 5 carbon atoms particularly covers those in which the heterocyclic ring thereof contains at least one oxygen, sulphur or nitrogen atom and as suitable examples can be given the radicals of oxiran, tetrahydrofuran, dioxan and pyran.

It is fundamentally possible to use the compounds of formula (I) in the form of their salts or other precursors, which can promote solubility. In individual cases only this can lead to the desired solubility. It is therefore possible to consider compounds which only release the compounds of formula (I) in the aqueous medium or allow the evolution of their activity there. The following quantity details relate to the compounds of formula (I) as such or their proportion within the suitable derivatives or compounds.

Within the scope of the invention, it is possible to use random suitable salts of the indicated ureas or urea derivatives, provided that they do not impair the desired action mechanism. It is e.g. possible to use chlorides, sulphates, particularly hydrogen sulphate, phosphates, particularly hydrogen phosphates. Urea phosphate is particularly effective. Crystallized in the pure form, urea phosphate are colourless, has a melting point of 118 to 119ø C., is soluble in water, alcohol, acetic acid, glycerin, ethylene glycol, etc. The aqueous solution reacts acid (1% solution pH value 1.8). Apart from widespread use as an artificial fertilizer (N/P source), it offers a further advantageous practical use as a result of its acid action in solders, melting fluxes, pickles, metal polishes and rust removers and as a catalyst for acid-catalyzed synthetic resins (cf. p 1723, R"mpp Chemie-Lexikon, Thieme Verlag, vol. 3, 9th edition, 1990). A proposal to use it for solving the aforementioned set problem in a solid or liquid effluent cleaner does not appear in the prior art and no teaching is provided in this connection.

Therefore the essence of the invention is to add to the solid or liquid effluent cleaner urea or the indicated derivatives or salts thereof in conjunction with the fat-degrading microorganisms, protease and an alkaline-acting agent. To a certain extent the urea or urea derivative used acts as a filler, dissolves pH-neutral, has a good water solubility, is inexpensive and aids the protease dissolving process. It is also an easily exploitable nitrogen source for fat-degrading bacteria.

Proteases are enzymes catalyzing the hydrolytic cleaving of the peptide bond in proteins and peptides. Use is more particularly made of a protease, which has increased activity in an aqueous, alkaline medium. The cleaning agent according to the invention also aims at low alkinity through the binding in of an alkaline-acting agent, also in liquid form, the pH-value preferably being in the range 8 to 12 and in particular approximately 9 to 10. Thus, the latter range represents the optimum. The protease quantity in the cleaning agent according to the invention is at least approximately 0.3 wt. %, particularly at least approximately 0.7 wt. %, based on dry substance or the solid content. Particular preference is given to a range between approximately 0.7 and 4 wt. %.

In view of the fact that there are different proteins in the plug to be removed from the sewer making the use of different proteases appear appropriate, preferably the proteases are used in the form of a mixture of at least 3 and in particular at least 4 different proteases. Use is more particularly made of those proteases, which have a protease activity in the alkaline pH-range. In the cleaning agent according to the invention they are more particularly in granulated form with a long term stability.

An essential part of the cleaning agent according to the invention is the use of fat-degrading microorganisms, particularly in the form of a mixed bacterial culture. The fat-degrading microorganisms are preferably present in a quantity of at least approximately 0.3 wt. %, particularly at least 0.7 wt. %, based on dry substance. Particular preference is given to the range of approximately 0.7 to 4 wt. %. The fat-degrading microorganisms degrade triglycerides and fatty acids, eliminate fat deposits and putrefaction odours and have a prophylactic action. In addition to the fat-degrading microorganisms, use can be made of lipases, particularly in the form of a mixture of different lipases. Lipases are enzymes belonging to the group of hydrolases, which cleave specific fats (triglycerides) into glyceride and fatty acids.

For the sought objective of the invention, it is also important that the claimed cleaning agent contains an alkaline-acting agent. An alkaline medium must be ensured for use and this is essential for the effects sought by the invention. The alkaline-acting agent is preferably in the form of an alkali metal and/or alkaline earth hydroxide and/or an alkaline-acting salt of an alkali metal and/or alkaline earth hydroxide. Sodium is preferred as the alkali metal in these compounds. In particularly preferred manner the alkaline-acting agent contains a mixture of sodium hydrogen carbonate and sodium carbonate. Particularly advantageous results are obtained if the mixture of sodium carbonate and sodium hydrogen carbonate is composed in such a way that there are approximately 2 to 4, particularly approximately 2.8 to 3.3 parts by weight sodium carbonate per part by weight sodium hydrogen carbonate. This mixture then sets an advantageous pH-range of approximately 8 to 11, particularly approximately 9 to 10. This pH-optimum also has an advantageous effect on the proteases used according to the invention with optimum effectiveness in the alkaline range.

The effects sought by the invention are improved by incorporating a surfactant, particularly a biodegradable surfactant, preferably in the form of a mixture of different surfactants. Preferably the surfactant quantity in the cleaning agent according to the invention, based on dry substance, is at least approximately 0.3, particularly at least approximately 0.7 wt. %. Preference is given to the range approximately 0.7 to 2.5 wt. %.

Surfactants are solubilizers, virtually all of them being surface-active. The choice of the most suitable solubilizer for the aqueous systems considered is based on the HLB system. These can in particular be anionic surfactants, such as fatty alcohol sulphonates, cationic surfactants, such as quaternary ammonium compounds, nonionic emulsifiers or solubilizers, such as fruit acid esters of mono-diglycerides, e.g. citrates and the like. As with all the essential constituents of the cleaning agent according to the invention, the aim here is that they are biodegradable under the use conditions. The surfactants make an important contribution to the dissolving of fats in the deposits to be removed. They also have a dissolving action on the proteases in the solid, inventive cleaning agent following introduction into the liquid phase of the sewer.

In order to increase the activity of the fat-degrading bacteria, it is particularly advantageous to incorporate into the inventive cleaning agent a carbon source for the same, particularly in the form of an organic acid, but which largely limits its acid functionality in the alkali medium, so that here its possible germ-inhibiting action does not come fully to bear or is excluded. These can be the organic acids mentioned hereinbefore in connection with the prior art, particularly citric acid, e.g. in the form of the aldehyde in the solid cleaning agent according to the invention.

The citric anhydride not only has the function of a carbon source, but in conjunction with the preferred alkali medium sodium hydrogen carbonate/sodium carbonate leads to dissolving, accompanied by gas production, which aids the complete operational sequences of the cleaning agent according to the invention when used. Thus, there is a bubbling action, the dissolving process of the constituents of the agent and an acoustic feedback are assisted and also constitutes an easily exploitable carbon source for the fat-degrading bacteria.

In order to increase the effects sought by the invention it is possible to add fat, protein and carbohydrate-degrading enzymes to the cleaning agent, particularly in the form of carbohydrate-degrading enzymes, preferably cellulase. The alkaline medium assists the fat and protein-dissolving properties of the enzymes and microorganisms contained in the product.

With a view to special applications, it is also possible to incorporate fillers with additional characteristics, e.g. in the form of sodium sulphate, sodium chloride and/or saccharose. As is conventional, to the cleaning agent according to the invention can also be added perfumes and/or dyes. These are in particular limonene/orangene terpenes. A suitable quantity range is between approximately 0.1 and 0.001 wt. %, based on dry substance. Thus, limonene/orangene terpenes produce a pleasant odour and a different perfume oil can also be used. It is optionally possible to use amino acids, such as cysteine.

From the technical standpoint the invention can be explained as follows:

All the indicated constituents which must or which are preferably used according to the invention reveal a functional interaction on achieving the sought technical result, which is not referred to in the prior art. With regards to the individual, technical processes, reference is made to the above statements. It is particularly necessary to stress the high proportion of urea or urea derivative or salt. Compared with the standard, prior art cleaning agents, the cleaning agent according to the invention is highly superior. With such a high urea quantity it virtually reaches the action of caustic soda (30 minutes), namely a dissolving of the comparison plug within 4 hours. Accompanied by the addition of water at 50ø C., there is a further improvement to the action. It is also possible to bring about the heating in that prior to the use of the cleaning agent according to the invention anhydrous magnesium sulphate is introduced into the sewer. As a result of hydration energy this leads to a desired, high heating.

The invention is further illustrated hereinafter by means of an example.

EXAMPLE

Composition 71.0% urea 17.9% Na2CO3

6.55.% NaHCO3

1.0% citric anhydride 1.0% biodegradable surfactant 1.0% protease active in alkaline medium 1.0% fat-degrading mixed bacterial culture (for fat degradation, particularly edible fats, fats of all types and also mineral fats)

0.55% limonene/orangene terpenes

The activity of this cleaning agent was measured against standardized plugging materials in a beaker and in a glass sewer bend. The cleaning agent was added at a temperature of 15ø C. The plug in the glass sewer bend was dissolved under the selected conditions after approximately 4 hours and the plugging effect was completely removed.

What is claimed is:

1. A cleaning agent comprising (i) 50 to 90 wt. % of urea, urea derivative, urea salt and/or a urea derivative salt, based on dry substance, and (ii) an alkaline-acting agent which ensures an alkaline medium, protease, and at least 0.3 wt. % of fat-degrading microorganisms based on any dry substance.

2. Cleaning agent according to claim 1, comprising 60 to 80 wt. % urea.

3. Cleaning agent according to claim 1, wherein the protease has increased activity in an aqueous, alkaline medium.

4. Cleaning agent according to claim 1, wherein the protease comprises at least 0.3 wt. % based on dry substance.

5. Cleaning agent according to claim 4, wherein the protease quantity is between 0.7 and 4.0 wt. %.

6. Cleaning agent according to claim 1, wherein the fat-degrading microorganisms are present in the form of a mixed bacterial culture.

7. Cleaning agent according to claim 1, wherein the quantity of fat-degrading microorganism is between 0.7 and 4.0 wt. %.

8. Cleaning agent according to claim 1, wherein the alkaline activity agent comprises an alkali metal and/or alkaline earth hydroxide and/or an alkaline-acting salt of an alkali metal and/or alkaline earth hydroxide.

9. Cleaning agent according to claim 8, wherein the alkaline-acting agent comprises a mixture of sodium hydrogen carbonate and sodium carbonate.

10. Cleaning agent according to claim 9, wherein the mixture of sodium carbonate and sodium hydrogen carbonate, contains 2 to 4 parts by weight sodium carbonate per part by weight of sodium hydrogen carbonate.

11. Cleaning agent according to claim 1, further comprising a surfactant.

12. Cleaning agent according to claim 11, comprising at least 0.3 wt. % surfactants based on dry substance.

13. Cleaning agent according to claim 12, wherein the surfactants are present in a quantity of between 0.7 and 2.5 wt. %.

14. Cleaning agent according to claim 1, further comprising a conventional carbon source for the fat-degrading microorganisms.

15. Cleaning agent according to claim 14, wherein the carbon source is an organic acid.

16. Cleaning agent according to claim 15, wherein the organic acid is citric acid in the form of its anhydride.

17. Cleaning agent according to claim 1, further comprising carbohydrate-degrading enzymes.

18. Cleaning agent according to claim 1, wherein the protease comprises a mixture of at least 3 different proteases.

19. Cleaning agent according to claim 1, which further comprises a mixture of at least 3 different lipases.

20. Cleaning agent according to claim 1, wherein the surfactant comprises a mixture of at least 3 different surfactants.

21. Cleaning agent according to at claim 11, which further comprises fillers in the form of sodium sulphate, sodium chloride and/or saccharose.

22. Cleaning agent according to claim 1, which further comprises perfumes and/or dyes.

* * * * *